US009004152B2

(12) United States Patent
Yoshihara

(10) Patent No.: US 9,004,152 B2
(45) Date of Patent: Apr. 14, 2015

(54) HEAT EXCHANGE DEVICE FOR POWDER AND GRANULAR MATERIAL, AND METHOD FOR MANUFACTURING THE SAME

(75) Inventor: Ichiro Yoshihara, Tokyo (JP)

(73) Assignee: Nara Machinery Co., Ltd., Tokyo (JP)

( * ) Notice: Subject to any disclaimer, the term of this patent is extended or adjusted under 35 U.S.C. 154(b) by 741 days.

(21) Appl. No.: 13/126,921

(22) PCT Filed: Oct. 22, 2009

(86) PCT No.: PCT/JP2009/068548

§ 371 (c)(1),
(2), (4) Date: Apr. 29, 2011

(87) PCT Pub. No.: WO2010/053035

PCT Pub. Date: May 14, 2010

(65) Prior Publication Data

US 2011/0203784 A1 Aug. 25, 2011

(30) Foreign Application Priority Data

Nov. 6, 2008 (JP) ..... 2008-285039

(51) Int. Cl.

*B01F 15/06* (2006.01)
*F28D 11/02* (2006.01)
*F26B 11/16* (2006.01)
(Continued)

(52) U.S. Cl.

CPC ..... *F28D 11/02* (2013.01); *Y10T 29/4935* (2015.01); *F26B 11/16* (2013.01); *F26B 17/20* (2013.01); *F26B 17/28* (2013.01); *F28D 2021/0045* (2013.01); *F28F 5/04* (2013.01)

(58) Field of Classification Search

USPC ..... 165/86, 87, 92, 109.1, 120; 34/134
See application file for complete search history.

(56) References Cited

U.S. PATENT DOCUMENTS 1,656,790 A * 1/1928 Heijkenskjold ..... 165/90
2,111,178 A * 3/1938 Crumback ..... 416/200 R
(Continued)

FOREIGN PATENT DOCUMENTS

JP B2-30-3138 5/1955
JP A-48-104140 12/1973
(Continued)

OTHER PUBLICATIONS

International Search Report mailed on Dec. 1, 2009 for the corresponding International patent application No. PCT/JP2009/068548.

*Primary Examiner* — Marc Norman
*Assistant Examiner* — Devon Russell
(74) *Attorney, Agent, or Firm* — Posz Law Group, PLC

(57) ABSTRACT

A heat exchange device for powdery and granular materials configured to reduce adherence and accumulation of the materials and manufacturing time. The heat exchange device includes at least one substantially hollow disk-shaped heat exchanger among a plurality of heat exchangers that is disposed on the shaft about which the heat exchanger rotates. The hollow disc-shape heat exchanger includes a cutout recess part, plate surfaces extending from one side edge of the cutout recess part and forming a wedge-shaped plate surface, and a smoothly bulging projection formed at a central part of the heat exchanger. In addition, an opening is provided in the hollow disk-shaped heat exchanger at a tip end of the projection, and a shaft is inserted into the opening and joined to the hollow disc-shaped heat exchanger.

6 Claims, 10 Drawing Sheets

(51) Int. Cl.

| | |
|---|---|
| ***F26B 17/20*** | (2006.01) |
| ***F26B 17/28*** | (2006.01) |
| ***F28F 5/04*** | (2006.01) |
| *F28D 21/00* | (2006.01) |

(56) References Cited

U.S. PATENT DOCUMENTS

| | | | | | |
|---|---|---|---|---|---|
| 3,426,838 | A | * | 2/1969 | Onarheim | 165/87 |
| 3,500,901 | A | * | 3/1970 | Mery et al. | 165/86 |
| 3,613,777 | A | * | 10/1971 | Nara | 165/86 |
| 3,757,767 | A | * | 9/1973 | Ito et al. | 126/110 B |
| 3,800,865 | A | * | 4/1974 | Onarheim et al. | 165/92 |
| 4,039,024 | A | * | 8/1977 | List | 165/92 |
| 8,118,479 | B2 | * | 2/2012 | van Elderen et al. | 366/301 |
| 2010/0018671 | A1 | * | 1/2010 | Nara | 165/88 |

FOREIGN PATENT DOCUMENTS

| | | |
|---|---|---|
| JP | B1-48-44432 | 12/1973 |
| JP | A-2000-199684 | 7/2000 |
| JP | A-2006-220323 | 8/2006 |
| JP | A-2008-107009 | 5/2008 |

* cited by examiner

HEAT EXCHANGE DEVICE FOR POWDER AND GRANULAR MATERIAL, AND METHOD FOR MANUFACTURING THE SAME

CROSS REFERENCE TO RELATED APPLICATIONS

This application is a U.S. national stage application of PCT/JP2009/068548 filed on Oct. 22, 2009, and claims priority to, and incorporates by reference, Japanese Patent Application No. 2008-285039 filed on Nov. 6, 2008.

TECHNICAL FIELD

The present invention relates to a heat exchange device for drying, heating or cooling a powder and granular material, and a method for manufacturing the heat exchange device.

BACKGROUND ART

An indirect heat transfer type grooved agitating dryer is known as a heat exchange device for drying, heating or cooling a variety of powder and granular materials.

The device disclosed in, for example, Japanese Examined Patent Application Publication No. S48-44432 (Patent Literature 1, hereinafter) is known as such device.

In the device disclosed in Patent Literature 1, a shaft, having a plurality of heat exchangers disposed at predetermined intervals, is rotatably supported within a horizontally long casing. A heat exchange medium is supplied into the heat exchangers via the shaft, and the heat exchangers are rotated within the casing. This device is structured such that a powder and granular material is dried (heated, cooled) by indirect heat transferred from the shaft and heat exchangers.

Each of the heat exchangers disclosed in Patent Literature 1 has a structure shown in FIG. 11. The heat exchanger is a wedge-shaped hollow rotating body 50. The wedge-shaped hollow rotating body 50 is formed by joining two pieces of fan-shaped plate materials 51, 51 into contact with each other at one side of their ends while separating the fan-shaped plate materials 51, 51 at the other side of their ends, to block the periphery thereof with plate materials 52, 53. Therefore, the hollow rotating body 50 is shaped into a wedge in which a front end part 54 at the tip end in a rotation direction forms a line, while a rear end part 55 at the rear end in the rotation direction forms a surface. The device disclosed in Patent Literature 1 uses two of the wedge-shaped hollow rotating bodies 50 as a pair. In other words, these two wedge-shaped hollow rotating bodies 50 are disposed at symmetrical positions on a shaft 60 with certain gaps A, A therebetween, as shown in FIG. 12. Then a plurality of pairs of the two wedge-shaped hollow rotating bodies 50 are disposed at predetermined intervals in an axial direction of the shaft 60.

The indirect heat transfer type grooved agitating dryer disclosed in Patent Literature 1 had the following excellent characteristics:

(1) Small installation area, and small in size.

(2) Large heat transfer coefficient, and high heat efficiency.

(3) Self-cleaning effect achieved by the wedge-shaped hollow rotating bodies.

(4) The temperature of an object to be processed and the time for processing it can be controlled easily.

(5) Powder and granular material with high moisture content can be processed as well.

(6) Excellent piston flowability (transferability) of the object to be processed.

The device described in Patent Literature 1, however, had the following problems:

(a) The object to be processed adheres/accumulates in the angled parts other than the diagonal plate surface of the wedge of the heat exchanger, particularly in a section where the shaft and the wedge-shaped heat exchanger are attached. Adhesion/accumulation of the object to be processed reduces the heat-transfer area of the heat exchanger, lowering the heat efficiency of the device. Moreover, the adhered/accumulated object to be processed falls off of the heat exchanger as time advances, causing, in some cases or according to the heat history, different types of block objects to be mixed into the object to be processed.

(b) The production of the shaft provided with the wedge-shaped hollow rotating bodies requires an enormous amount of time. In other words, each wedge-shaped hollow rotating body 50 is fabricated by disposing the two pieces of fan-shaped plate materials 51, 51, an isosceles triangular plate material 52, and a trapezoidal plate material 53 in the manner shown in FIG. 13 and welding the entire periphery of the abutment parts between these materials. Therefore, when forming a single heat exchanger, there are many steps in the welding process alone, and automation of the welding operation is difficult. Furthermore, when fixing each of the obtained heat exchangers to the shaft 60, plate material 61 formed with cutout holes which are substantially the same shape as a part (opening) of each heat exchanger that is in contact with the shaft 60, is lined (welded) on the entire outer peripheral surface of the shaft 60, and thereafter the plate material 61, the shaft 60 and the parts of the heat exchangers abutting on the plate material 61 and the shaft need to be welded at the entire periphery of the abutting sections. In addition, in such welding, the welding methods of each layer need to be changed. For this reason, the problem of the device described in Patent Literature 1 is that an enormous amount of time is required in fabricating the heat exchangers.

There is also a device in which hollow disks are simply attached as heat exchangers to a shaft. The heat exchanger with such a configuration, however, cannot ensure the piston flowability of the object to be processed, which are the excellent characteristic of the wedge-shaped hollow rotating body disclosed in Patent Literature 1. This is because the piston flowability of the object to be processed can be ensured for the first time by allowing the object to be processed to pass regularly through the gaps A, A of the two wedge-shaped hollow rotating bodies 50, 50 attached to the shaft 60. Here, the piston flowability are important factors for realizing the first-in-first-out phenomenon of the object to be processed, as well as for obtaining residence time, heat history, reaction time and the like to keep each particle of the powder/granular even. The piston flowability are also important attributes of the heat exchange device in order to maintain the consistent quality of the object to be processed.

The gaps A, A described in Patent Literature 1 function to transfer a powder and granular material layer, which is formed at the nearest part (upstream side) within the device, from a raw material feeding port side to a product discharge side, in a manner that each wedge-shaped hollow rotating body 50 that is rotated by the rotation of the shaft cuts out the powder and granular material layer. At this moment, the wedge-shaped hollow rotating body 50 itself does not have an extrusion force that a screw has. For this reason, the powder and granular material is sliced regularly, such as twice per rotation, in order to be transferred by the gaps A, A simply using the pressure of the powder and granular material. Therefore, back mixing or short pass seldom occurs on the powder and granular material in this device, so that "the first-in-first-out phenomenon" can be ensured and the piston flowability can be realized. On the other hand, in the case of simple hollow disk-shaped rotating bodies, the object to be processed is transferred from a gap between a casing and each rotating body to a downstream side. As a result, the back mixing or short pass phenomenon occurs where a part of the powder and granular material layer in the vicinity of the shaft remains in its position, while a part of the same near the casing moves rapidly. Thus, in the case of such simple hollow disk-shaped rotating bodies, the piston flowability cannot be realized.

DISCLOSURE OF THE INVENTION

The present invention was contrived in view of the above-described problems of the background art. An object of the present invention is to provide a heat exchange device for a powder and granular material, which is capable of suppressing an object to be processed from adhering/accumulating, while keeping high heat efficiency, piston flowability and other advantages of the conventional device that uses the wedge-shaped hollow rotating bodies, and reducing the man-hour of manufacturing processes (time). The present invention also aims to provide a method for manufacturing such heat exchange device.

In order to achieve the object described above, a heat exchange device for a powder and granular material according to the present invention is a heat exchange device for a powder and granular material, which is configured such that a shall is rotatably supported within a horizontally long casing, a plurality of heat exchangers are disposed on the shaft at predetermined intervals, a heat exchange medium is supplied into the heat exchangers via the shaft, and the heat exchangers are rotated within the casing, wherein at least one of the plurality of heat exchangers is formed as a substantially hollow disk-shaped heat exchanger in which a cutout recess part directed from a circumferential edge of the heat exchanger toward a center of the heat exchanger is provided; plate surfaces extending from one side edge of the cutout recess part to another side edge of a following cutout recess part are formed into a wedge-shaped plate surface by gradually increasing a distance between the plate surfaces; a projection that smoothly bulges in a horizontal direction as viewed from the side is formed at a central part of the heat exchanger; and an opening is formed at a tip end of the projection, and the heat exchanger is disposed on the shaft by inserting the shaft into the opening of the substantially hollow disk-shaped heat exchanger having the wedge-shaped plate surface.

According to the present invention, it is preferred that the cutout recess parts of the heat exchangers be formed into a substantially trapezoidal shape. It is also preferred that the cutout recess part of the heat exchanger be provided in a number of two at symmetrical positions on the circumferential edge, and that the plate surfaces between the two cutout recess parts be formed into the wedge-shaped plate surface.

In order to achieve the object described above, a method for manufacturing a heat exchange device for a powder and granular material according to the present invention is a method having: a step of press-forming members that are obtained by dividing a substantially hollow disk-shaped heat exchanger having wedge-shaped plate surface, into two at the middle in a thickness direction, the heat exchanger being used in the device of the present invention; and a step of joining the press-formed two members into abutment with each other in a direction in which peripheral edge parts thereof abut on each other, fabricating the substantially hollow disk-shaped heat exchanger having the wedge-shaped plate surface by welding the two members at the peripheral edge parts abutting on each other, and fixing the heat exchanger to the shaft by welding the heat exchanger to the shaft at a peripheral edge of the opening formed at the tip end of the projection of the heat exchanger.

According to the present invention, it is preferred that the step of fabricating the heat exchanger and fixing the heat exchanger to the shaft include a step of joining the press-formed two members into abutment with each other in a direction in which the peripheral edge parts thereof abut on each other, and welding the two members at the peripheral edge parts abutting on each other, a step of inserting the shaft into the opening of the substantially hollow disk-shaped heat exchanger having the wedge-shaped plate surface fabricated by the welding, and disposing the heat exchanger, which is provided in plurality, on the shaft, and a step of welding the disposed heat exchangers to the shaft at the peripheral edge of the opening formed at the tip end of the projection of each of the heat exchangers. Alternatively, according to the present invention, it is preferred that the step of fabricating the heat exchanger and fixing the heat exchanger to the shaft include a step of successively inserting the shaft into the openings of a pair of the press-formed two members, to thereby dispose a plurality of pairs of press-formed members on the shaft, and a step of sequentially welding the disposed members at the peripheral edge parts abutting on each other, and welding the peripheral edge of the opening formed at the tip end of the projection to the shaft.

According to the heat exchange device for powder and granular material according to the present invention, each of the heat exchangers disposed on the shaft has a cutout recess part directed from a circumferential edge of the heat exchanger toward a center of the same, and plate surfaces extending from one side edge of the cutout recess part to another side edge of a following cutout recess part are formed into a wedge-shaped plate surface where the thickness of the plate surfaces increases gradually. Therefore, according to this heat exchange device, the gap between the wedge-shaped plate surfaces of two adjacent heat exchangers becomes gradually narrow from one side edge of the heat exchanger to the other side edge, and the heat exchanger cuts into a layer of an object to be processed as the shaft rotates. As a result, a compression force can be gradually acted on the layer of the object to be processed in the narrowing gap between the wedge-shaped plate surface, and the compression force can be released at once by the cutout recess part. Thus, the powder and granular material layer, which is the object to be processed, can be compressed and expanded repeatedly by the rotation of the shaft, whereby the powder and granular material can be heated or cooled efficiently. In other words, compressing the powder and granular material layer between the gradually narrowing wedge-shaped plate surfaces means compressing an internal air layer. Thus, lowering of a heat insulation effect and enhancement of heat transfer can be realized. On the other hand, the powder and granular material layer is released from the compression and expands at the cutout recess part located at a terminal end of the wedge-shaped plate surfaces, and consequently vaporized materials and the like contained in the gap between the powder and granular material can be emitted to the outside the system. Such a device of the present invention is capable of exerting the effect of repeatedly compressing and expanding the powder and granular material layer, to achieve high heat efficiency. Each of the heat exchangers used in the present invention has the cutout recess part directed from the circumferential edge of the heat exchanger toward the center of the same, as described above. Therefore, the heat exchange device can allow the passage of the object to be processed from the cutout recess part of the heat exchanger, ensuring the piston flowability of the object to be processed.

In addition, according to the heat exchange device for a powder and granular material according to the present invention, the projection that smoothly bulges in the horizontal direction as viewed from the side is formed at the central part of each heat exchanger, the tip end of the projection is formed into an opening, and the heat exchanger and the shaft are fixed by inserting the shaft into the opening. According to this heat exchange device, the section where the heat exchanger and the shaft are attached forms a smooth curved surface that does not allow the adhesion/accumulation of the object to be processed. As a result, the heat exchanger and the shaft can ensure a wide heat-transfer area, to realize the device having high heat efficiency. Moreover, the adherence or accumulation of the object to be processed is prevented, hence the falling off thereof and the mixing thereof into block objects do not occur, namely a highly reliable heat exchange operation for a powder and granular material can be realized.

In the heat exchange device for a powder and granular material according to the present invention, the entire configuration of each heat exchanger is in the shape of a substantially simple hollow disk. This allows the heat exchange device to reduce the man-hour of manufacturing processes (time) significantly in order to achieve easy automation of the welding operation.

According to the method for manufacturing the above-described heat exchange device for a powder and granular material according to the present invention, when fabricating each of the heat exchangers it is only necessary to perform only one welding operation on the peripheral edge part thereof where the two pieces of press-formed members abut on each other (there is only one weld line). Thus, the welding operation can be performed in a short time, facilitating the automation of the welding operation. When fixing each heat exchanger to the shaft, it is only necessary to insert the shaft into the opening formed in the heat exchanger, and to weld the heat exchanger to the shaft at the opening peripheral edge. This leads to a simple welding operation and a significant reduction of the welding time. In this case as well, since only one weld line is formed, the automation can be realized incredibly easily.

BEST MODE FOR CARRYING OUT THE INVENTION

Embodiments of the abovementioned heat exchange device for a powder and granular material according to the present invention and a method for manufacturing such a heat exchange device are now described in detail with reference to the drawings.

Figure 1:
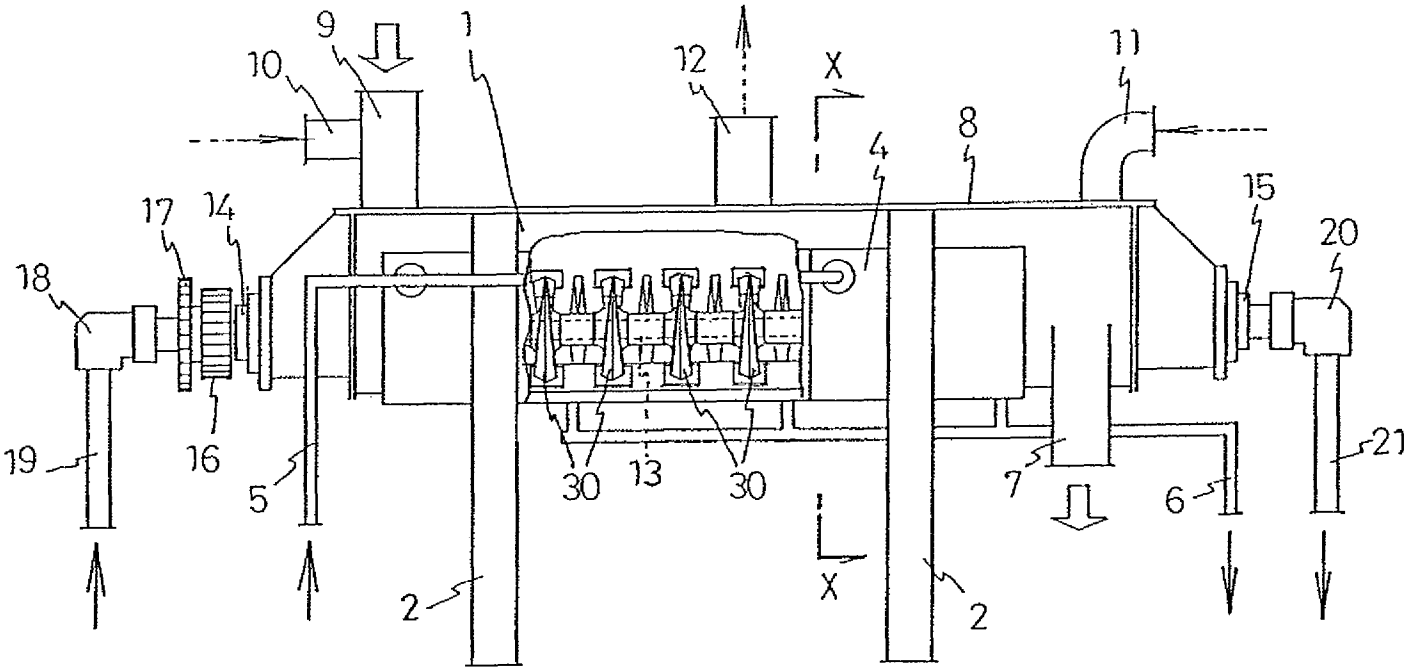
FIG. 1 is a cutaway side view showing a part of a heat exchange device for a powder and granular material according to the present invention.
Figure 2:
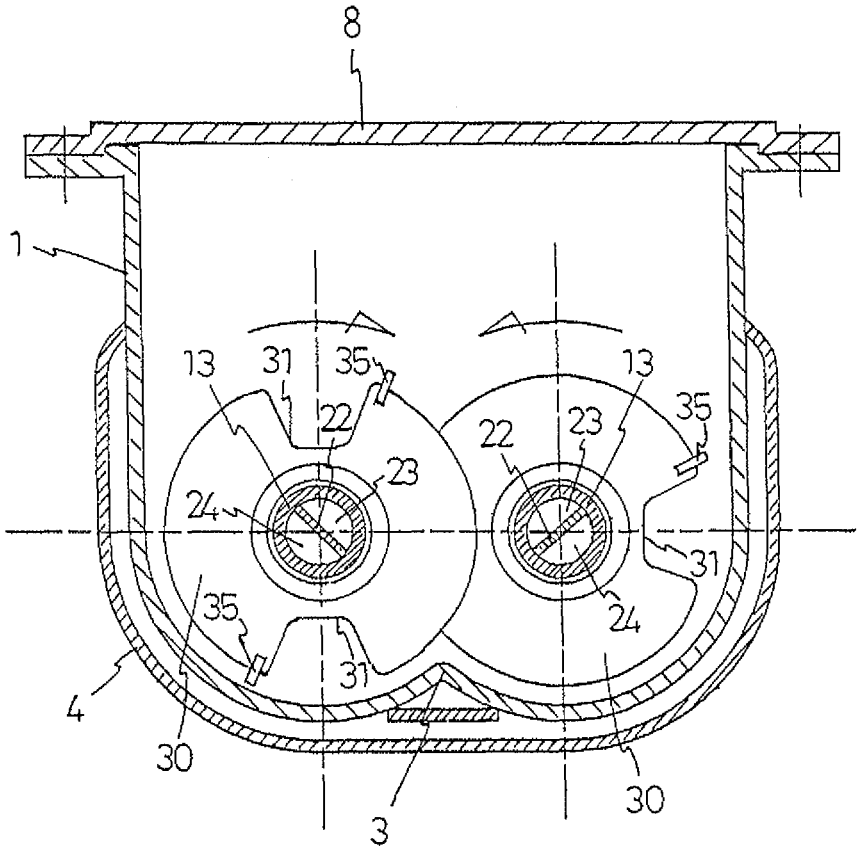
FIG. 2 is an enlarged cross-sectional view taken along line X-X of FIG. 1.

In FIGS. 1 and 2, reference numeral 1 represents a casing of the heat exchange device, which is a relatively horizontally long container. This casing 1 is slightly inclined by supports 2 according to need. As shown in FIG. 2, the cross section of the casing 1 is in the shape of a bowl defined by two circular arcs. At a central bottom part of the bowl, a raised body 3, formed into a convex shape by the circular arcs, runs in a front-to-rear direction of the casing 1. A heat exchange jacket 4 is provided on substantially the entire surface including bottom and side surfaces of the casing 1.

As shown in FIG. 1, a supply pipe 5 and discharge pipe 6 for supplying and discharging a heat exchange medium are connected to the heat exchange jacket 4. A rear end bottom part of the casing 1 is provided with a discharge port 7 for discharging an object to be processed, and a cover 8 is attached to an upper surface of the casing 1 by a bolt or the like. A front end part of the cover 8 is provided with a feed port 9 for feeding the object to be processed, the front end part and rear end part of the cover 8 with carrier gas inlet ports 10, 11 respectively, and a central part of the cover 8 with a carrier gas discharge port 12.

Two hollow shafts 13, 13 run parallel through in the front-to-rear direction of the casing 1. These two hollow shafts 13, 13 are supported by bearings 14, 14 and 15, 15 provided in the front and rear parts of the casing 1, so as to be freely rotatable. Front parts of the shafts 13, 13 are provided with gears 16, 16, respectively. The gears 16, 16 are meshed with each other so that the shafts 13, 13 rotate in the directions opposite to each other. One of the shafts 13 is provided with a sprocket 17. The rotation of a motor (not shown) is transmitted to the shafts 13, 13 via a chain (not shown) meshed with this sprocket 17.

Supply pipes 19, 19 for supplying the heat exchange medium are connected respectively to front ends of the shafts 13, 13 via rotary joints 18, 18. Similarly, discharge pipes 21, 21 for discharging the heat exchange medium are connected respectively to rear ends of the shafts 13, 13 via rotary joints 20, 20. As shown in FIG. 2, each of the shafts 13, 13 is provided with a partition plate 22, 22 dividing the inside of the shaft 13 into two in an axial direction. The inside of the shaft 13 is divided by the partition plate 22 into a primary chamber 23 and a secondary chamber 24. The primary chamber 23 is communicated with a front part of the shaft 13, while the secondary chamber 24 is communicated with a rear part of the shaft 13. In this state, although not particularly shown, the above configurations can be realized by sealing a front end of the secondary chamber 24 with a crescentic end plate in the front part of the shaft 13 and sealing a rear end of the primary chamber 23 with a crescentic end plate in the rear part of the shaft 13.

Figure 10:
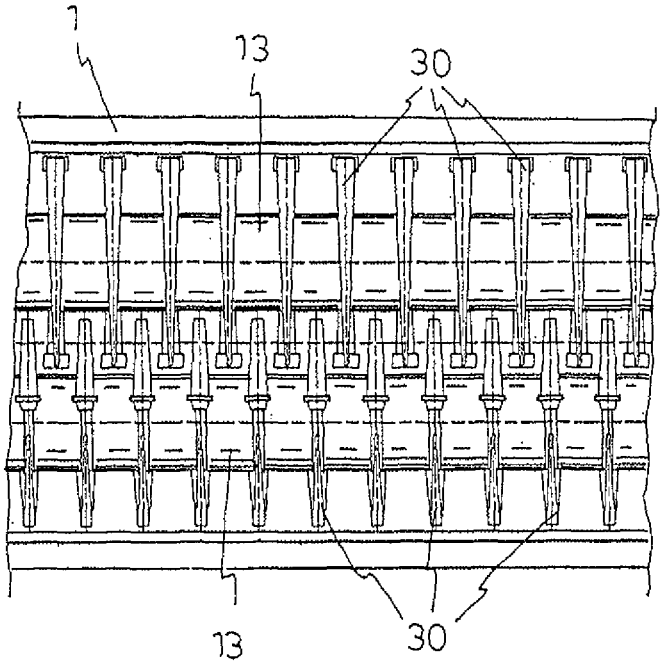
FIG. 10 is a plan view showing how the shaft with the heat exchanger is placed within a casing.
Figure 11:
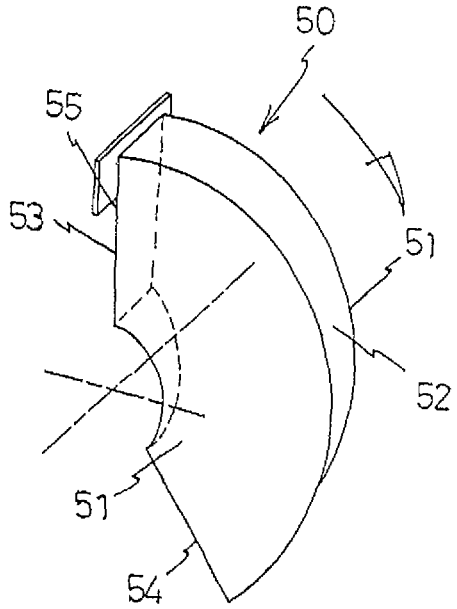
FIG. 11 is a perspective view of a conventional heat exchanger.

In addition, in each of the shafts 13, 13, a plurality of heat exchangers 30, 30 . . . are disposed at predetermined intervals, in a manner that one of the heat exchangers 30, cuts into (is overlapped on) the other one, as shown in FIGS. 2 and 10.

Figure 3:
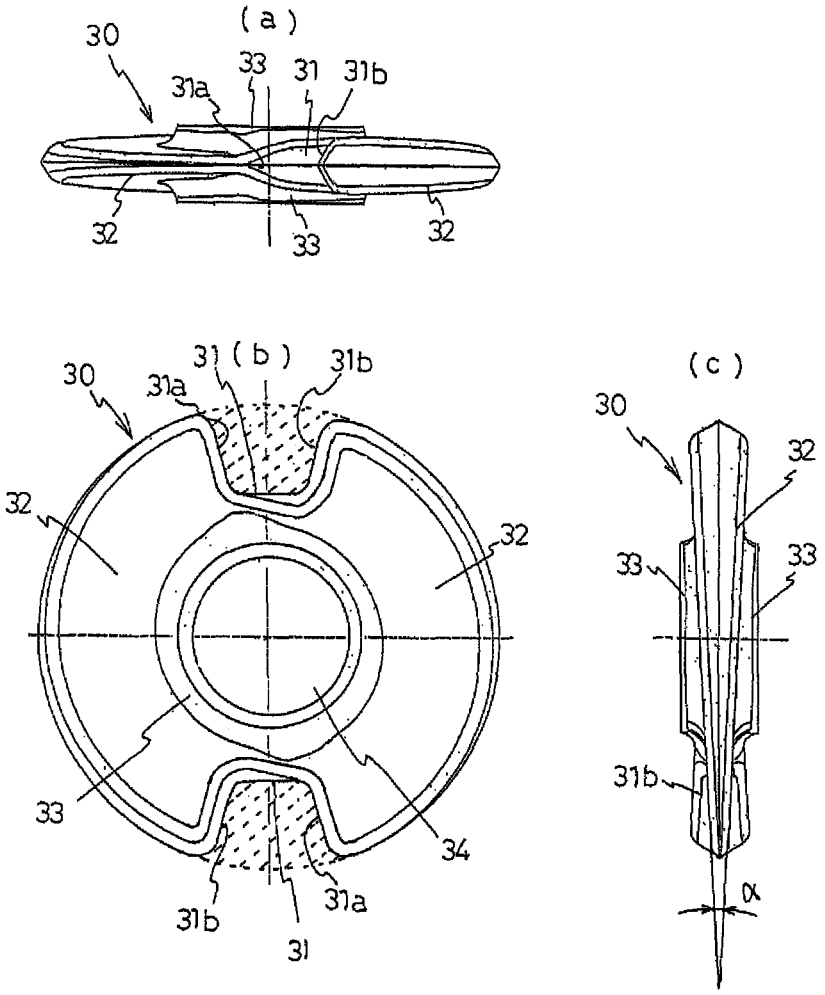
FIG. 3 shows a heat exchanger, wherein (a) is a plan view, (b) a front view, and (c) a side view.
Figure 4:
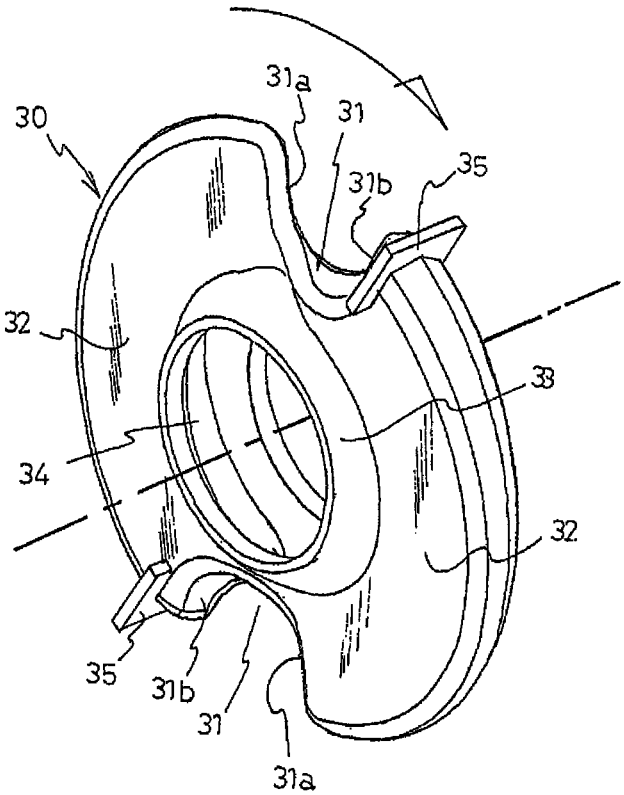
FIG. 4 is a perspective view of the heat exchanger.

As shown in FIGS. 3 and 4, each of the heat exchangers 30 has, at symmetrical positions, two substantially trapezoidal cutout recess parts 31, 31 that are directed toward the center of the heat exchanger 30 from a circumferential edge of the same. Plate surfaces extending from one side edge 31*a* of one of the cutout recess parts 31 to another side edge 31*b* of the other cutout recess part 31 are formed into wedge-shaped plate surfaces 32, 32 by gradually increasing a distance between the plate surfaces. A central part of the heat exchanger 30 has projections 33, 33 that bulge smoothly in a horizontal direction as viewed from the side. Tip ends of the projections 33, 33 are formed into openings 34, 34. The entire heat exchanger 30 is in the shape of a substantially hollow disk.

Figure 12:
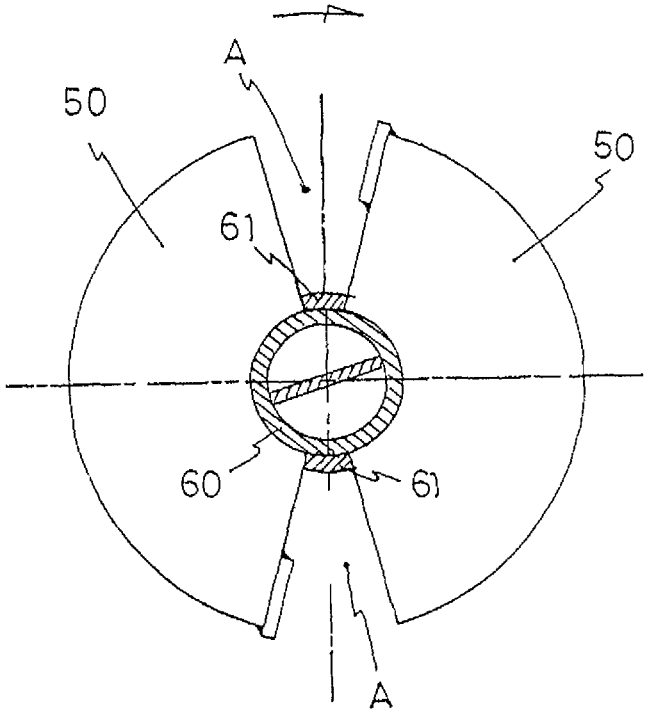
FIG. 12 is a front view of the conventional heat exchanger disposed on a shaft.
Figure 13:
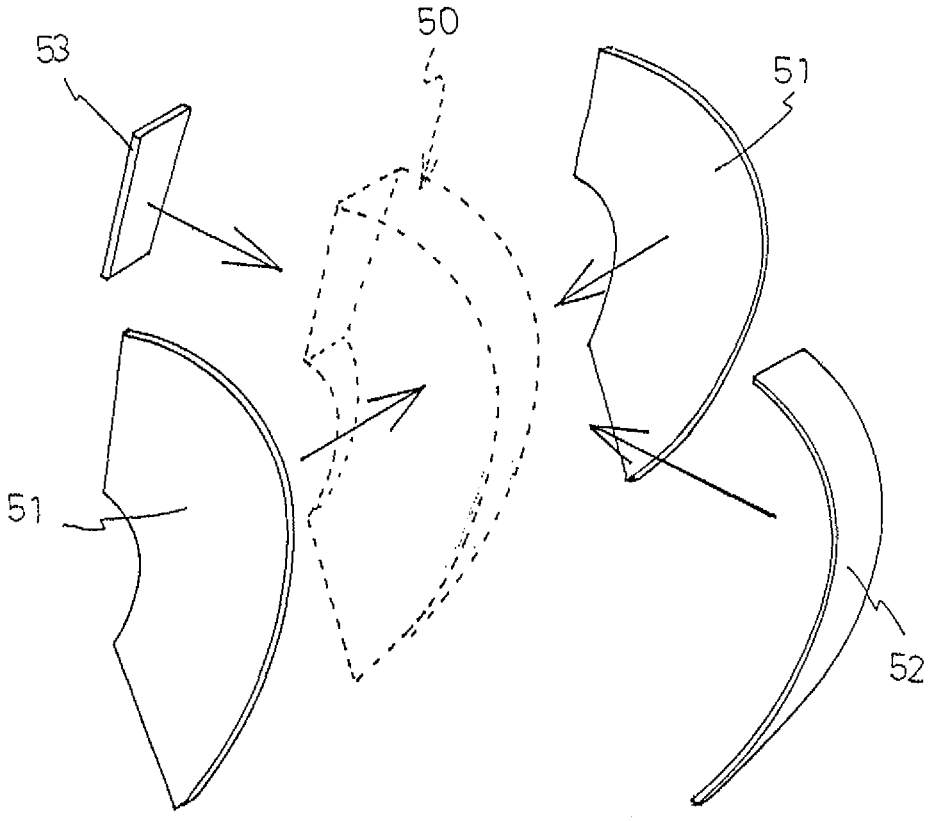
FIG. 13 is an exploded perspective view of components of the conventional heat exchanger.

Note that the number of the cutout recess parts 31 formed in the heat exchanger 30 is not limited to two. In other words, each of the cutout recess parts 31 may have an opening area that is large enough to allow the passage of the object to be processed. More specifically, the areas of the cutout recess parts 31 (the parts with dotted diagonal lines in FIG. 3(*b*)) may be substantially equal to the areas of two fan-shaped gaps A, A that are formed between two wedge-shaped hollow rotating bodies 50, 50 attached to the same perpendicular surface of a shaft 60 of the conventional technology shown in FIG. 12. Therefore, the number of the cutout recess parts 31 may be one, three, or more. However, when there are two or more of the cutout recess parts 31, it is preferred that the cutout recess parts 31 be disposed at regular intervals in a circumferential direction, and that the plate surfaces of the cutout recess parts 31 be formed into the wedge-shaped plate surfaces 32 described above. It is also preferred that the inclined surfaces of the wedge-shaped plate surfaces 32 formed in the heat exchanger 30 be bilaterally symmetric to each other. An apex angle formed by the wedge-shaped plate surfaces 32, 32 (shown by a in FIG. 3(*c*)) is preferably 4 to 8 degrees.

A plurality of the heat exchangers 30 with the above configuration are disposed on each of the shafts 13 at regular intervals such that the cutout recess parts 31 are arranged in the same direction. The gaps between the heat exchangers may be ensured by joining the tip ends of the projections 33, 33 of the adjacent heat exchangers 30, 30 into abutment on each other when the shafts 13 are inserted into the openings 34 of the respective heat exchangers 30. Interposition of an independent sleeve between the adjacent heat exchangers 30, 30 may ensure the formation of the gaps between these heat exchangers.

When there are two cutout recess parts 31 in each heat exchanger 30, the two shafts 13, 13 are placed in the casing 1 in a manner that the cutout recess parts 31, 31 of the heat exchanger 30 are shifted by 90 degrees and that the heat exchanger 30 cuts into (is overlapped on) the other, as shown in FIG. 2. Note that the number of shafts 13 is not limited two and may be, for example, four or more, or even one (uniaxial). Also, the heat exchangers disposed on the shafts 13 may all be the above-mentioned substantially hollow disk-shaped heat exchangers 30 with the wedge-shaped plate surfaces. Also, the heat exchangers may be combined appropriately with other heat exchangers having different structures, in accordance with the property of the object to be processed, to obtain a structure in which the substantially hollow disk-shaped heat exchangers 30 with the wedge-shaped plate surfaces are attached to the shafts 13.

As shown in FIG. 4 and the like, a scraping blade 35 is attached in the vicinity of the side edge 31*b* of the cutout recess part 31 located on the rear end side of the wedge-shaped plate surface 32 of the heat exchanger 30. This scraping blade 35 may be attached to all of the heat exchangers 30. Depending on the property of the object to be processed, the scraping blade 35 can be attached to every other heat exchanger 30 or to every some heat exchanges 30, or attached to none of the heat exchangers 30.

Figure 5:
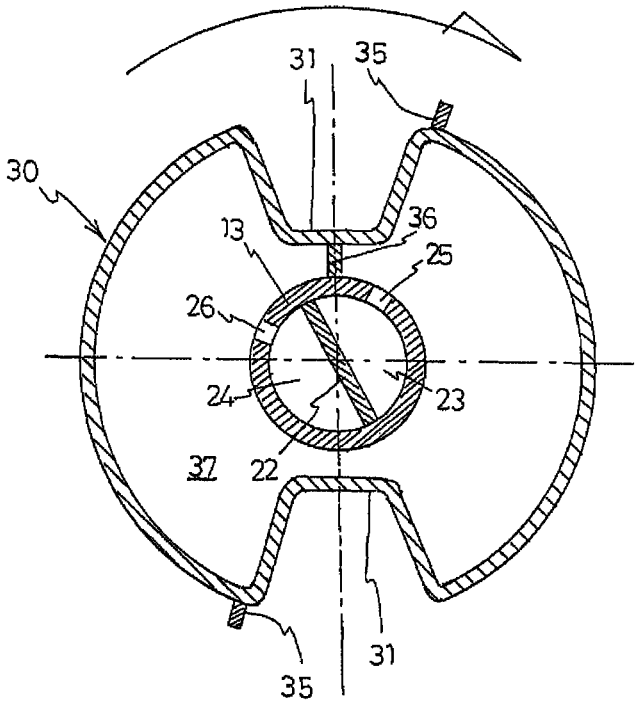
FIG. 5 is a vertical cross-sectional view of the heat exchanger disposed on a shaft.

As shown in FIG. 5, a partition plate 36 is attached to the inside of each heat exchanger 30. This partition plate 36 divides an internal space 37 of the heat exchanger 30 to form a flow in which the heat exchange medium flowing from the primary chamber 23 of the abovementioned shaft 13 into the internal space 37 of the heat exchanger 30 via a continuous hole 25 circulates through the internal space 37 in a fixed direction and flows out to the secondary chamber 24 of the shaft 13 via a continuous hole 26. Note that in the case of a relatively small device, there may be one partition plate 36. Conversely, in the case of a large device, a plurality of partition plates 36 may be provided to divide the internal space 37 of the heat exchanger 30 more finely, and similarly the continuous holes 25, 26 for communicating the internal space 37 with the primary chamber 23 and the secondary chamber 24 of the shaft may be provided.

The heat exchanger 30 with the above configuration can be fabricated as follows.

Figure 6:
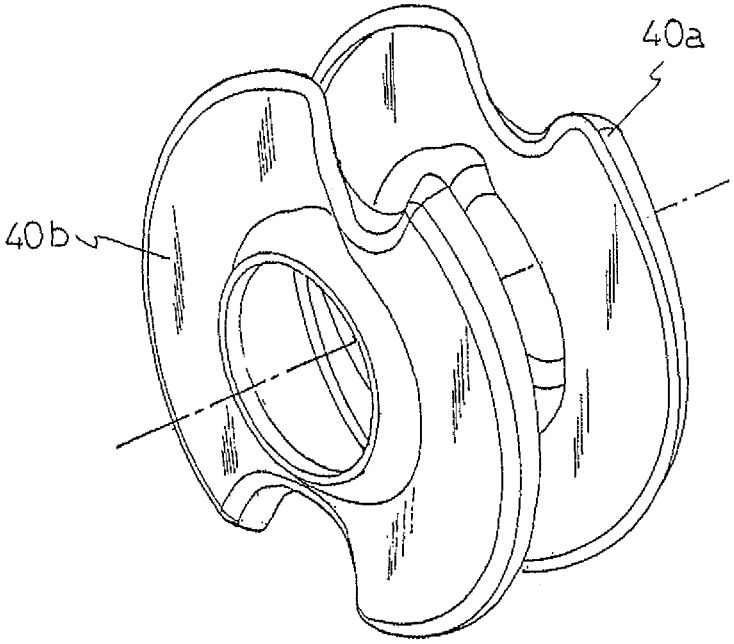
FIG. 6 is a perspective view showing press-formed members used for fabricating the heat exchanger.
Figure 7:
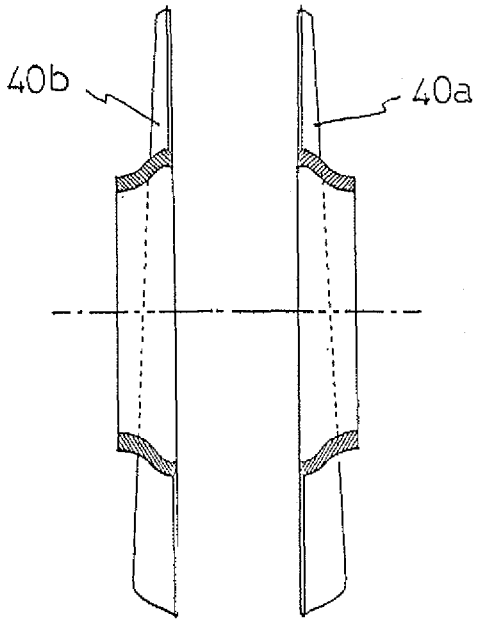
FIG. 7 is a side cross-sectional view showing the press-formed members used for fabricating the heat exchanger.

First, as shown in FIGS. 6 and 7, members 40*a*, 40*b*, which are obtained by dividing the substantially hollow disk-shaped heat exchanger 30 with the wedge-shaped plate surfaces into two pieces at the middle in a thickness direction, are fabricated by press-forming a plate material. This press-forming may be performed at once using a pair of molds. The press-forming may be performed separately on peripheral edge parts, the plate surface parts, the central part and the like using separate molds. Each of these parts may be press-formed slowly in multiple steps. However, it is preferred that the members 40*a*, 40*b* be formed slowly in at least a plurality of steps, in order to precisely form the members 40*a*, 40*b* without deforming them. The plate material may be cut first in consideration of the shape and size of the finished heat exchanger 30, and then this cut plate material may be press-formed. Moreover, a press-forming machine with a cutting function may be used for cutting the peripheral edges and punching the central part simultaneously with the forming process.

Figure 8:
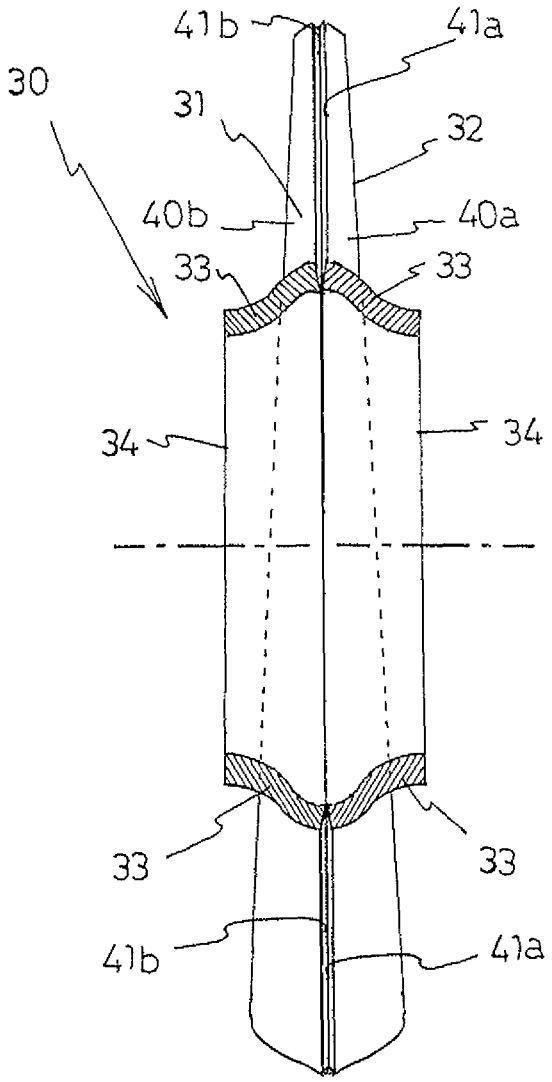
FIG. 8 is a side cross-sectional view showing how the press-formed members are welded together.

Subsequently, the fabricated two members 40*a*, 40*b* are joined into abutment on each other in a direction in which peripheral edge parts 41*a*, 41*b* abut on each other, as shown in FIG. 8. The entire circumferences of the abutting peripheral edge parts 41*a*, 41*b* are welded to form the substantially hollow disk-shaped heat exchanger 30 that has the wedge-shaped plate surfaces shown in FIG. 4. In so doing, the partition plate 36 dividing the internal space of the heat exchanger 30, stays (not shown) for providing reinforcement if necessary, and other components are also attached in the heat exchanger 30 by means of welding and the like.

Figure 9:
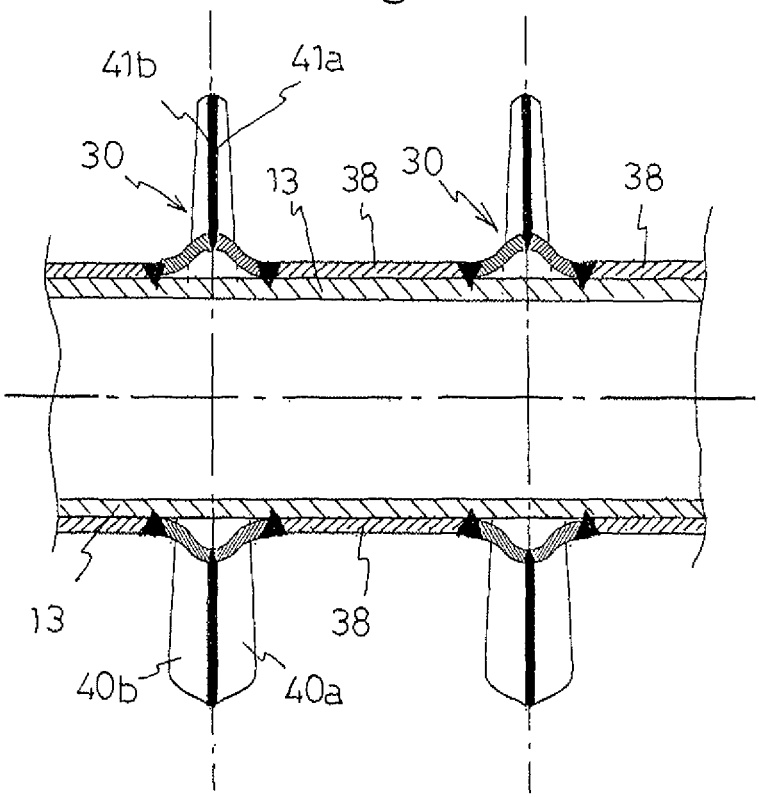
FIG. 9 is a side cross-sectional view showing how the heat exchanger is welded to the shaft.

Thereafter, the shaft 13 is inserted into the openings 34 of the fabricated heat exchanger 30. A sleeve 38 for determining the gaps between the heat exchangers 30 is inserted into the shaft 13. In this manner, the plurality of the heat exchangers 30, 30, . . . are placed on the shaft 13. The entire circumference of the abutment part between each projection 33 of each heat exchanger 30 placed on the shaft 13 and an end part of the sleeve 38 is welded, as shown in FIG. 9. Through these processes, each heat exchanger 30 is welded and fixed to the surface of the shaft 13. Then, the scraping blade 35 is attached to an appropriate section of the heat exchanger 30 by means of welding or the like. The shaft 13 on which the pluralities of heat exchangers 30, 30, . . . are disposed at predetermined intervals is placed within the casing 1, as shown in FIG. 10, to fabricate the heat exchange device.

Unlike the processes described above, the shaft 13 is inserted into the openings 34 without welding the press-formed pair of two members 40*a*, 40*b*. After placing a plurality of pairs of press-formed members 40*a*, 40*b* on the shaft 13, the peripheral edge parts 41*a*, 41*b* that abut on the members 40*a*, 40*b* placed on the shaft 13 are welded, and subsequently peripheral edges of the openings 34 formed at the tip ends of the projections and the shaft 13 are welded together. This is the method for manufacturing the heat exchange device, which has the step of fabricating the substantially hollow disk-shaped heat exchangers 30 having the wedge-shaped plate surfaces and the step of fixing the heat exchangers 30 to the shaft 13.

When fabricating each of the heat exchangers 30 of the present invention, only one section needs to be welded (there is only one weld line), i.e., the peripheral edge parts 41*a*, 41*b* that abut on the two press-formed members 40*a*, 40*b*. Thus, the welding operation can be performed in a short time, facilitating the automation of the welding operation. The heat exchanger 30 can be welded and fixed to the shaft 13 by welding the heat exchanger 30 to the shaft 13 along the peripheral edges of the openings 34 formed at the tip ends of the projections 33 of the heat exchanger 30. This can reduce the welding time significantly. In this case as well, the automation of the welding process can be realized incredibly easily because only one weld line is formed. In addition, when a conventional wedge-shaped heat exchanger 50 is welded, manual welding to the shaft 60 is necessary; a multi-layer welding method shall be employed, where the welding method according to the layers as mentioned above. On the other hand, the heat exchanger 30 of the present invention allows to use an automatic welding to the shaft 13; the automatic welding of a single layer can complete the heat exchanger 30 by selecting an appropriate welding condition. This can further reduce the welding time. When fabricating the conventional wedge-shaped heat exchanger 50 itself, multi-layer welding needs to be performed to weld the sections where the plate materials abut on each other. The heat exchanger 30 of the present invention, however, can be completed by automatically welding a single layer. Similarly, this can further reduce the welding time. Furthermore, the projections 33 of the heat exchanger 30 of the present invention can play the role of the plate material (lining) 61, which is required when attaching the conventional wedge-shaped heat exchanger 50 to the shaft 60. Therefore, the amount and number of materials can be cut, reducing the man-hour of manufacturing processes.

Next is described how a powder and granular material is dried using the heat exchange device of the present invention described above.

First, a powder and granular material (may be either a powder material or a granular material), which is the object to be processed, is continuously supplied at a constant amount from the feed port 9 of the heat exchange device of the present invention in the casing 1. In so doing, a heating medium of a predetermined temperature, such as steam or hot water, is circulated through the jacket 4 to heat the casing 1 to a fixed temperature. The two shafts 13, 13 are rotated by the motor via the sprocket 17 and gears 16, 16. The heating medium, such as steam or hot water, is fed to the shafts 13, 13 by the supply pipes 19, 19 for supplying the heat exchange medium, via the rotary joints 18, 18. The heating medium fed to each shaft 13 flows from the primary chamber 23 of the shaft 13 into the internal space 37 of the heat exchanger 30, to heat the heat exchanger 30. The heating medium used for heating the heat exchanger 30 is then discharged from the discharge pipes 21 of the heat exchange medium through the secondary chamber 24 of the shaft and the rotary joint 20 of the rear part of the shaft.

The powder and granular material supplied into the casing 1 is heated by the casing 1 and the heat exchanger 30, and volatile matters that are evaporated from the powder and granular material are discharged along with carrier gas. Air, inert gas or the like, for example, is used as the carrier gas. The carrier gas supplied from the inlet ports 10, 11 passes through an upper layer part within the casing 1, and is then discharged from the discharge port 12 along with the volatile matters evaporated from the powder and granular material (water vapor, organic solvent, and the like). The carrier gas containing the volatile matters evaporated from the powder and granular material is then appropriately processed outside the system. When the volatile matters are organic solvent, inactive gas such as nitrogen gas is used as the carrier gas, and the discharge port 12 is coupled to a solvent condenser where the organic solvent is recovered. The carrier gas that passes through the condenser enters the casing 1 again through the inlet ports 10, 11, and is circulatorily used.

Flowability is generated in the powder and granular material by performing a mechanical agitating operation when the powder and granular material enters the casing 1 through the feed port 9. The fed powder and granular material then gradually flows down the casing 1 by means of the pressure generated as the powder and granular material fills the feed port 9 and the inclination of the casing 1 that is provided according to need. The powder and granular material then passes through the cutout recess parts 31 of the heat exchangers 30 and moves to the discharge port 7.

The powder and granular material is pushed aside by the rotation of the substantially hollow disk-shaped heat exchanger 30 perpendicular to a direction of travel, and at the same time the heat is exchanged so that the powder and granular material is dried efficiently. Particularly, the heat exchanger 30 used in the present invention has the cutout recess parts 31 directed from circumferential edge of the heat exchanger 30 toward the center of the same, wherein the plate surfaces extending from the side edge 31*a* of the cutout recess part 31 to the side edge 31*b* of the following cutout recess part 31 are formed into the wedge-shaped plate surfaces 32 where the plate surfaces become gradually thick. For this reason, the gap between the wedge-shaped plate surface 32, 32 of the adjacent two heat exchangers 30, 30 becomes gradually narrow from the side edge 31*a* to the side edge 31*b* of the heat exchangers 30. In this state, each of the heat exchangers 30 cuts into the powder and granular material layer as the shaft 13 rotates. Therefore, the compression force can be applied gradually to the powder and granular material layer in the gradually narrowing gap between the gradually narrowing wedge-shaped plate surfaces 32, 32. Furthermore, the compression force can be released at once at the cutout recess parts 31, once the powder and granular material layer passes through the side edge 31*b*. In this manner, the powder and granular material layer can be compressed and expanded repeatedly by the rotation of the shaft, whereby the powder and granular material can be dried efficiently. In other words, compressing the powder and granular material layer in the gradually narrowing gap between the wedge-shaped plate surfaces 32, 32 means compressing an internal air layer. Thus, lowering of the heat insulation effect and enhancement of heat transfer can be realized. On the other hand, the powder and granular material layer is released from the compression and expands in the cutout recess part located at a terminal end of the wedge-shaped plate surfaces, and consequently the vaporized materials and the like contained in the powder and granular material can be emitted to the outside the system. Such a device of the present invention is capable of exerting the effect of repeatedly compressing and expanding the powder and granular material layer, to achieve high heat efficiency. In the device according to the embodiments, the heat exchangers 30 with the wedge-shaped plate surfaces 32 and cutout recess parts 31 for accomplishing the actions and effects are placed in the casing 1 in a manner that the heat exchanger 30 cuts into (is overlapped on) the other, as shown in FIGS. 2 and 10. This improves the repeated compression and expansion of the powder and granular material layer, resulting in the device with high heat efficiency. Each of the heat exchangers 30 has the cutout recess parts 31, as described above. This allows the passage of the powder and granular material from the cutout recess parts 31, ensuring the piston flowability. The powder and granular material that is obtained after a uniform residence time is smoothly sent toward the discharge port 7 and discharged from the discharge port 7.

The central part of the heat exchanger 30 used in the present invention has the projections 33 that bulge smoothly in the horizontal direction as viewed from the side. The tip ends of the projections are formed into the openings 34. The shaft 13 is inserted into the openings 34 in order to fix the heat exchanger 30 to the shaft 13. The section where the heat exchanger 30 and the shaft 13 are attached forms a smooth curved surface that does not allow the adhesion/accumulation of the powder and granular material, which is the object to be processed. As a result, the heat exchanger 30 and the shaft 13 can ensure a wide heat-transfer area, realizing the device having high heat efficiency. Moreover, because the adhered/accumulated object to be processed is prevented from falling off of the heat exchanger and mixing into the block objects, a highly reliable heat exchange operations for a powder and granular material can be realized.

The above has described the embodiments of the heat exchange device for a powder and granular material according to the present invention and the method for manufacturing such a heat exchange device, but the present invention is not limited to these embodiments, and, of course, various modifications and changes can be made within the scope of the technical concept of the present invention that is described in the patent claims.

A plurality of the heat exchange devices may be coupled together in series, when the degree of dryness of the object to be processed needs to be enhanced. In addition, the shaft on which the heat exchangers are disposed may be added more and provided in parallel, when the amount of throughput needs to be increased.

The device of the present invention can be used for drying objects to be processed, such as moist powder, granular materials, and block materials such as dehydrated cake. For example, the device of the present invention can be used in a step of drying inorganic substances such as aluminum hydroxide, titanium oxide and carbon graphite, food organic substances such as flour and cornstarch, and dehydrated products of synthetic resins such as polyester, polyvinyl alcohol and polypropylene. The device of the present invention can also be used in a step of heating and reacting substances such as sodium triphosphate that reacts after being dried.

INDUSTRIAL APPLICABILITY

The heat exchange device for a powder and granular material according to the present invention is used for drying, heating, cooling, and reacting a powder and granular material in a wide range of fields including synthetic resins, food products and chemical products.

The invention claimed is:

1. A heat exchange device for a powder and granular material, which comprises:

a casing having an elongated structure that extends horizontally;

supports supporting the casing;

front and rear ports respectively configured to supply a powder and granular material into and out of the casing, the front and rear ports being arranged at front and rear ends of the casing;

two hollow shafts each haying an axis and holes extending radially from the axis, the two hollow shafts being rotatably supported within the casing and extending in parallel from the front end to the rear end of the casing, and the two hollow shafts rotating in opposite directions relative to each other within the casing;

a plurality of heat exchangers joined to each hollow shaft at predetermined intervals along each hollow shaft, each plurality of heat exchangers being in fluid communication respectively with a corresponding hollow shaft of the two hollow shafts by the holes of the corresponding hollow shaft, and the plurality of heat exchangers rotating together with each corresponding hollow shaft within the casing:

each of the plurality of heat exchangers comprising:

opposing plates having plate surfaces joined together into a hollow disk-shaped heat exchanger including two cutout recess parts respectively arranged at two symmetrical positions about the common axis of each hollow disk-shaped heat exchanger, each cutout recess part extending from a circumferential edge of the hollow disk-shaped heat exchanger toward the common axis of the hollow disk-shaped heat exchanger, the plate surfaces of the opposing plates being joined together and forming two wedges each having wedge-shaped plate surfaces extending between the two cutout recess parts, the wedge-shaped surfaces pressing the powder and granular material by rotation of the hollow disk-shaped heat exchanger, the wedge-shaped plate surfaces having a gradually increasing distance between the plate surfaces relative to the common axis of the hollow disk-shaped heat exchanger from a starting side edge of one of the two cutout recess parts to an ending side edge of another of the two cutout recess parts in the rotating direction and along the circumferential edge of the hollow disk-shaped heat exchanger, and each hollow disk-shaped heat exchanger further including:

a projection smoothly and circumferentially bulging toward the common axis of the corresponding hollow shaft and outwardly from an interior of each hollow disk-shaped heat exchanger, the projection having an opening located at a center of each hollow disk-shaped heat exchanger receiving the corresponding hollow shaft and the opening having a peripheral edge extending about the circumference of the corresponding hollow shaft and abutting a peripheral edge of a cylindrical sleeve, and the peripheral edge of the opening of each hollow disk-shaped heat exchanger and the cylindrical sleeve being secured to the corresponding hollow shaft and each other about the circumference of the shaft; and cylindrical sleeves arranged around each hollow shaft and having the peripheral edge extending about the circumference of each hollow shaft, each cylindrical sleeve being interposed between neighboring hollow disk-shaped heat exchangers arranged along a length of each hollow shaft and being joined to the projections of the neighboring hollow disk-shaped heat exchangers and to the corresponding hollow shaft, wherein the two cutout recesses of the plurality of disk-shaped heat exchangers disposed on each hollow shaft are identically arranged along each hollow shaft relative to the axial direction and the rotating direction of each hollow shaft when viewed along the axial direction of each hollow shaft, and wherein the two hollow shafts rotate in opposite directions with portions of the hollow disk-shaped heat exchangers above each hollow shaft moving toward each other and portions of the plurality of hollow disk-shaped heat exchangers below each hollow shaft moving away from each other.

2. The heat exchange device for a powder and granular material according to claim 1, wherein the two cutout recess parts of each hollow disk-shaped heat exchanger are formed into a substantially trapezoidal shape.

3. A method for manufacturing the heat exchange device for a powder and granular material according to claim 2, comprising:

a step of press-forming the opposing plates each having a wedge-shaped plate surface, the wedge-shaped plate surfaces of the opposing plates having a gradually increasing distance between the plate surfaces relative to the common axis of the hollow disk-shaped heat exchanger from the starting side edge of one of the two cutout recess parts to the ending side edge of another of the two cutout recess parts in the rotating direction and along the circumferential edge of the hollow disk-shaped heat exchanger; and a step of aligning the press-formed opposing plates into abutment with each other in a direction in which peripheral edge parts thereof abut on each other and fabricating each hollow disk-shaped heat exchanger having the wedge-shaped plate surfaces by welding the opposing plates at the peripheral edge parts abutting on each other, and a step of fixing the heat exchanger to the corresponding hollow shaft by welding the heat exchanger to the corresponding hollow shaft at the peripheral edge of the opening of the heat exchanger.

4. A method for manufacturing the heat exchange device for a powder and granular material according to claim 1, comprising:

a step of press-forming the opposing plates each having the wedge-shaped plate surface, the wedge-shaped plate surfaces of the opposing plates having a gradually increasing distance between the plate surfaces relative to the common axis of the hollow disk-shaped heat exchanger from the starting side edge of one of the two cutout recess parts to the ending side edge of another of the two cutout recess parts in the rotating direction and along the circumferential edge of the hollow disk-shaped heat exchanger; and a step of aligning the press-formed opposing plates into abutment with each other in a direction in which peripheral edge parts thereof abut on each other and fabricating each hollow disk-shaped heat exchanger having the wedge-shaped plate surfaces by welding the opposing plates at the peripheral edge parts abutting on each other, a step of arranging the cylindrical sleeve adjacent the fabricated heat exchanger, and a step of fixing the fabricated heat exchanger to the corresponding hollow shaft and to the cylindrical sleeve by welding the heat exchanger to the corresponding hollow shaft and the cylindrical sleeve at the peripheral edges of the opening of the heat exchanger and the cylindrical sleeve.

5. The method for manufacturing the heat exchange device for a powder and granular material according to claim 4, further comprising:

a step of inserting the corresponding hollow shaft into the openings of the plurality of hollow disk-shaped heat exchangers fabricated by the welding and disposing the hollow disk-shaped heat exchangers on the corresponding hollow shaft, and a step of welding the disposed hollow disk-shaped heat exchangers to the corresponding hollow shaft at the peripheral edge of the opening of each of the hollow disk-shaped heat exchangers.

6. The method for manufacturing the heat exchange device for a powder and granular material according to claim 4, further comprising:

a step of successively inserting the corresponding hollow shaft into the openings of a pair of the press-formed opposing plates and arranging a plurality of pairs of press-formed opposing plates on the corresponding hollow shaft, and a step of sequentially welding the disposed members at the peripheral edge parts abutting on each other and welding the peripheral edge of the opening and fabricating each hollow disk-shaped heat exchanger that forms the two wedges to the corresponding hollow shaft.

* * * * *